United States Patent [19]

Stokley et al.

[11] Patent Number: 5,010,966

[45] Date of Patent: Apr. 30, 1991

[54] DRILLING METHOD

[75] Inventors: Charles O. Stokley, Houston; Richard C. Haas, Corpus Christi, both of Tex.

[73] Assignee: Chalkbus, Inc., Houston, Tex.

[21] Appl. No.: 509,203

[22] Filed: Apr. 16, 1990

[51] Int. Cl.[5] ..... E21B 21/06

[52] U.S. Cl. ..... 175/66; 175/206; 175/207

[58] Field of Search ..... 175/66, 206, 207; 55/189, 38, 40, 44, 43, 171, 172; 210/804

[56] References Cited

U.S. PATENT DOCUMENTS

| | | | |
|---|---|---|---|
| 2,082,329 | 6/1937 | Foran et al. | 175/206 X |
| 2,748,884 | 6/1956 | Erwin | 175/206 X |
| 2,786,652 | 3/1957 | Wells | 175/206 X |
| 3,500,943 | 3/1970 | Bingham, Jr. | 175/66 |
| 3,633,687 | 11/1972 | West et al. | 175/206 X |
| 3,895,927 | 7/1975 | Bournham, Sr. | 55/189 X |
| 4,247,312 | 1/1981 | Thakur et al. | 175/206 X |
| 4,666,471 | 5/1987 | Cates | 175/66 X |
| 4,887,464 | 12/1989 | Tannenbaum et al. | 175/66 X |

FOREIGN PATENT DOCUMENTS

| | | | |
|---|---|---|---|
| 2602588 | 8/1976 | Fed. Rep. of Germany | 175/66 |

*Primary Examiner*—Hoang G. Dang
*Attorney, Agent, or Firm*—M. H. Gay

[57] ABSTRACT

A method of receiving returns from a well being drilled in which the hydrostatic pressure of the drilling fluid cannot contain the formation pressure and controlling the flow and pressure of the returns and separating the oil, gas, and drilling fluids on the surface and returning the drilling fluids to the well while disposing of the oil and gas.

3 Claims, 4 Drawing Sheets

DRILLING METHOD

This invention relates to drilling methods and more particularly to drilling with light drilling fluids to reduce the possibility of damage to a formation during drilling. More particularly the invention relates to controlling the returning fluids from a well which is flowing during drilling.

In the drilling of a well into a formation which contains oil or gas, the pressure contained in the formation may cause flow into the well and subsequently to the surface. In the drilling of most wells, the hydrostatic pressure exerted by the drilling fluids is maintained to be greater than the pressure in the formations which are penetrated by the borehole. If these conditions are maintained, no flow of oil or gas into the wellbore will occur. If such drilling fluid hydrostatic pressures are greatly in excess of formation pressures, drilling fluids may enter into the formation. Loss of conventional bentonitic muds into a formation is widely known to cause plugging of the formation which may reduce or even stop flow of oil and gas into the wellbore when production is desired after drilling of the well is complete.

It is often of great advantage to maintain the hydrostatic pressure of the drilling fluids at or below the formation pressures and to use a drilling fluid which does not contain any solid material which may plug the formation. One such drilling fluid is water with a soluble material such as a salt added to adjust the hydrostatic pressure exerted at the formation. When drilling with these types of fluids, penetration into an oil and gas bearing formation will often result in flow of fluids from the formation into the wellbore and subsequently up the borehole to the surface.

As oil and gas are flammable, the flow of these fluids to the surface presents a potential hazard to the personnel and equipment. These flows must be efficiently controlled and not allowed to reach a combustible state. In addition, the mixture of drilling fluids, oil and gas must be separated into their individual phases and further transported for reuse, sale or disposal.

It is an object of this invention to provide a method for drilling utilizing drilling fluids which will not damage the well formation and containing and separating the returning fluids from the well into oil and gas, and drilling fluid for recirculation.

It is a further object of this invention to provide a method as in the preceding object in which returning fluids are controlled as to both pressure and volume.

It is a further object of this invention to provide a method as in the preceding objects in which produced gas is separated under pressure from the returning fluids and then the liquids are depressurized, oil is removed and any released gases are safely disposed of.

Other objects and features of this invention will be apparent from the drawings, the specification and the claims.

In the drawings wherein like reference numerals indicate like parts and wherein an illustrative embodiment of this invention is shown:

Figure 1:
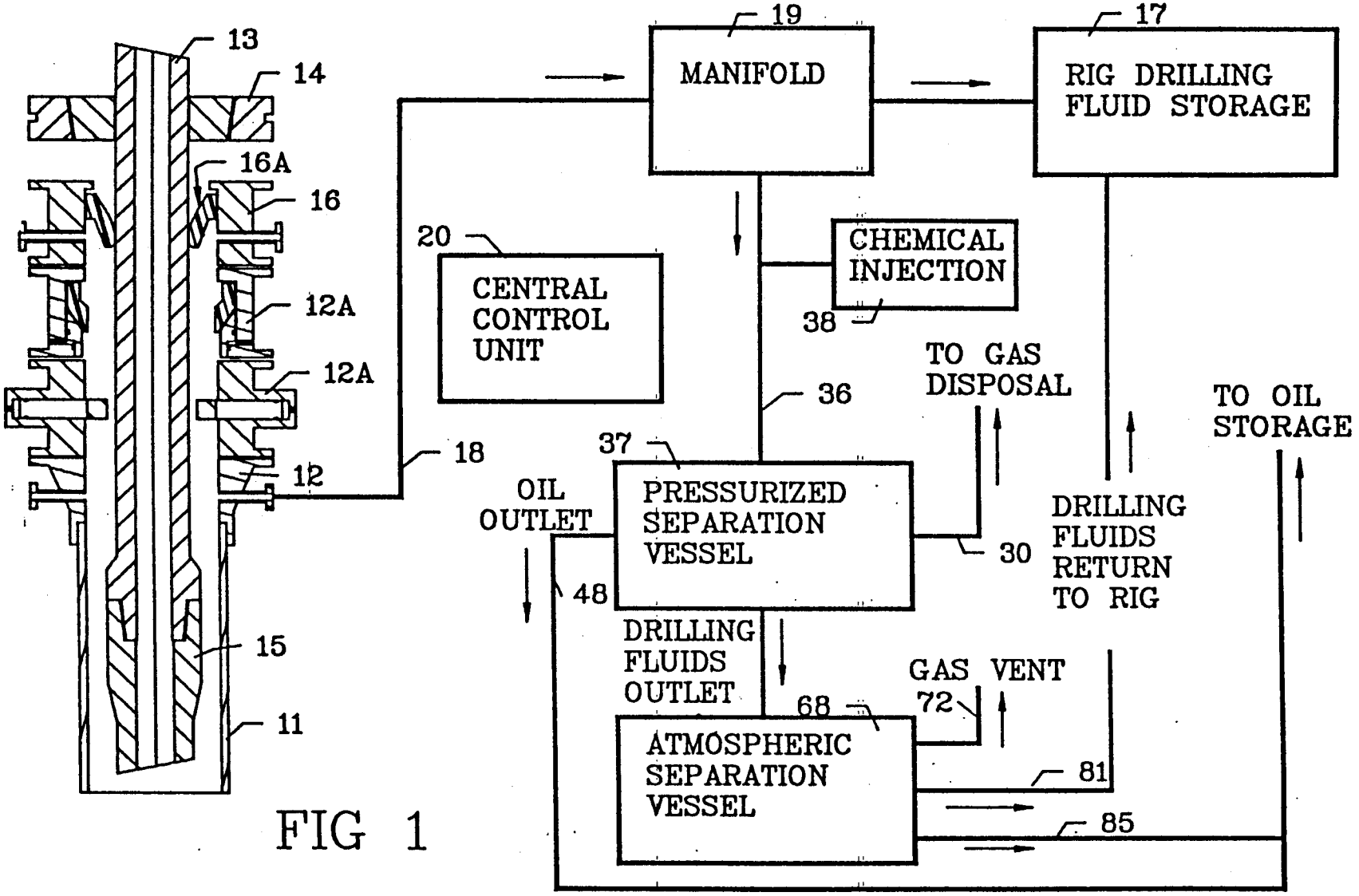
FIG. 1 is a sectional schematic of a wellhead in which a drill pipe is being rotated and a simplified block diagram showing the flow through each component of the system.

As illustrated in FIG. 1 a well is drilled through the usual surface casing 11 on which a casing head 12 and blowout preventers **12*a* are supported. During drilling a kelly 13 is rotated, as by a rotary table 14. The kelly and rotary table are provided by a conventional drilling rig (not shown). Suspended from the kelly is a drillpipe 15 which carries the bit (not shown). Fluid is contained in the casing head by the seal 16 which includes a resilient seal 16*a*** in engagement with the kelly.

During drilling, fluid is drawn from drilling fluid storage 17 and passes down the drillpipe and through the bit into the well. Return circulation is upwardly through the casing in conventional manner.

In accordance with this invention the drilling fluid employed will not damage the formation. No solid weight materials are used. Examples of non-damaging fluids are water (which may have its weight controlled as by the addition of a soluble salt, such as sodium chloride or ferric bromide), oil, water or oil emulsions, etc. As solid weight materials are not used, the hydrostatic pressure of the drilling fluid may not retain the formation fluids and they may be produced with the returning drilling fluids.

Fluid returns from the well are conducted from the casing head 12 via line 18 to the manifold 19. In the manifold they are directed to the drilling fluid storage tank 17 when the returns are all drilling fluid. In the event that the drilling fluids cannot retain the fluids in the formations penetrated and returning fluids contain well fluids the manifold controls these fluids and directs them to separation facilities. These facilities are shown in FIG. 1 and include the chemical injection, pressurized separation vessel and the atmospheric separation vessel. All equipment for handling returns are preferably controlled from the central control unit 20.

Figure 2:
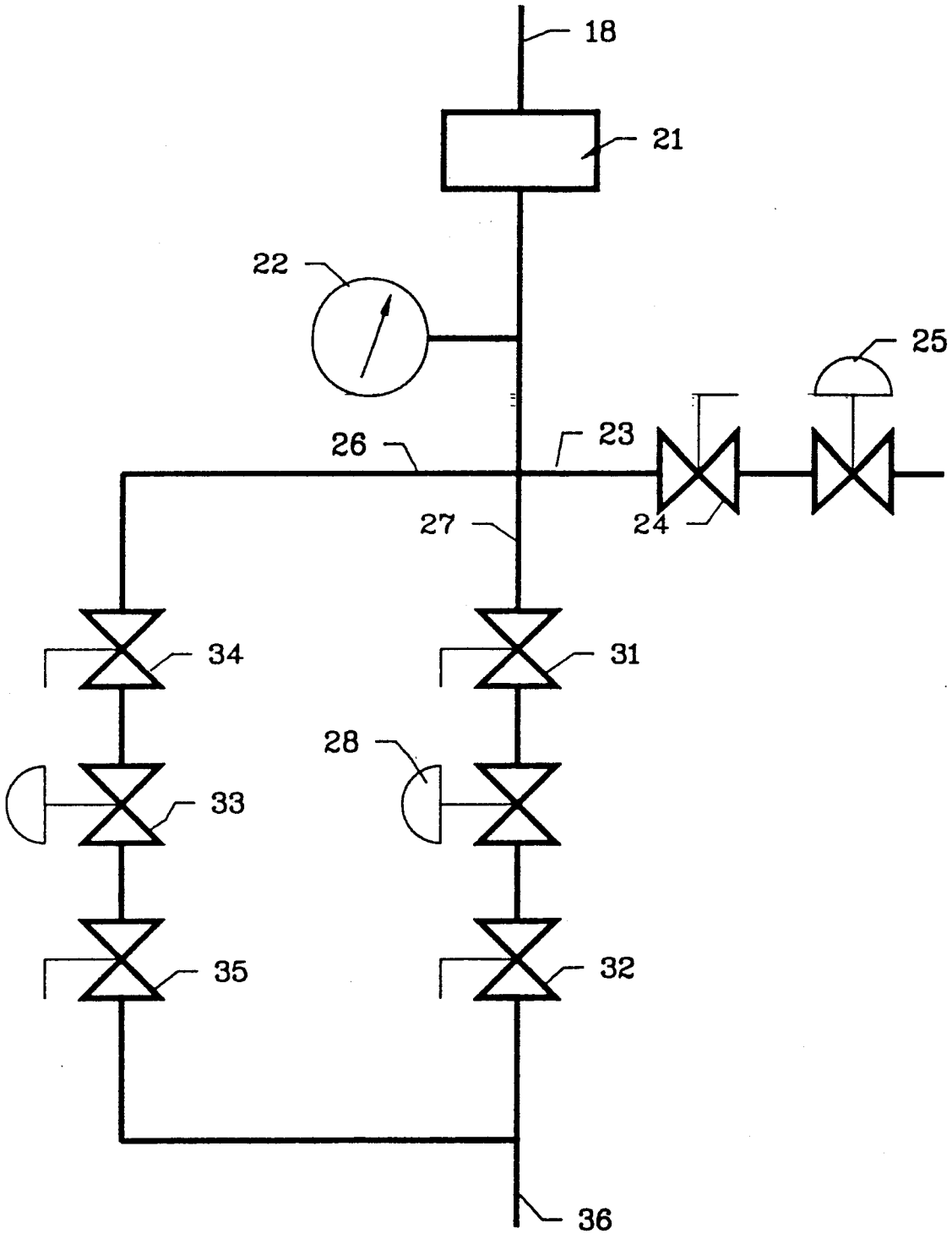
FIG. 2 is a schematic diagram of the manifold receiving flow from the well.
Figure 3:
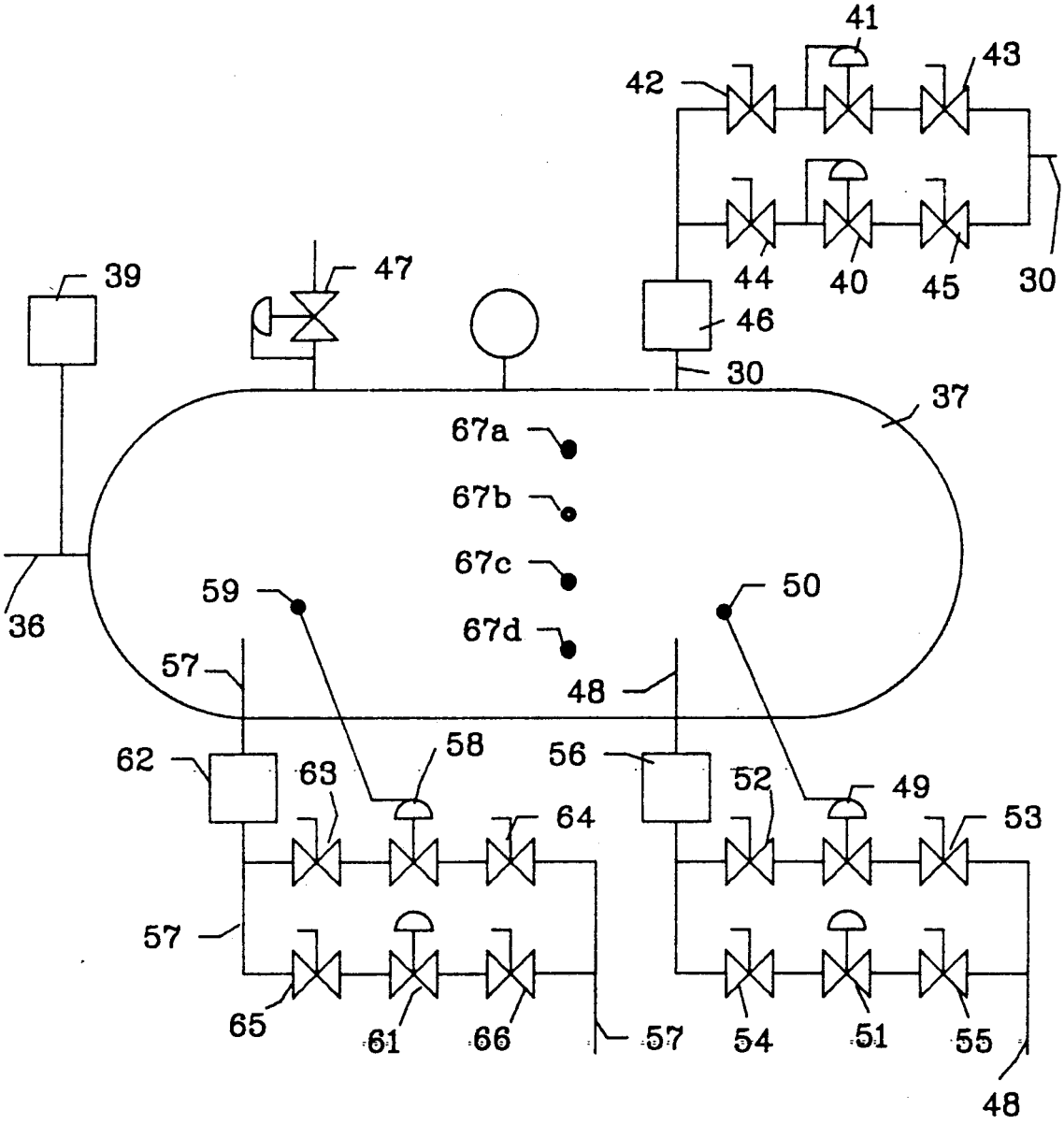
FIG. 3 is a schematic diagram of a preferred embodiment of a pressure vessel and associated valving for receiving flow from the manifold.

FIG. 2 illustrates a preferred manifold. In the manifold fluid first passes through a flow-no-flow device 21 which indicates if flow is or is not occurring. Pressure is indicated by gauge 22. When flow is occurring it is directed to the proper flow path by manifold 19. Flow in the absence of pressure will indicate an absence of well fluids and flow will be directed through line 23 and manual valve 24 and remote control valve 25 to the drilling fluid storage 17.

When gauge 22 shows pressure, well fluids are present and flow is directed to lines 26 and 27. Volume of flow is controlled by flow rate control valve 28 which is remotely controlled. Manual valves 31 and 32 permit isolation of valve 28 for repair. These three valves are of large flow capacity and sized to minimize any pressure losses through the valves so that artificially induced pressures are not held on the well. The valve 28 is adjustable to control flow rate from the well.

Line 26 contains a pressure control valve 33 between manual valves 34 and 35 so that the valve 33 may be isolated for repairs. The pressure control valve 33 automatically controls the well pressure and maintains the desired back pressure on the well. This desired back pressure may be controlled from a remote location. Valve 33 is preferably of a differential type and will limit the maximum pressure which is exerted on the well and the drilling equipment.

Flow from the manifold is directed by line 36 to the pressurized separator vessel 37. If desired chemicals such as de-emulsifying agents etc., may be injected into line 36 by chemical injector 38. Pressure separator 37 may be of any desired design and may contain baffles of varying height to channel fluids through the vessel. A remote pressure transmitter 39 monitors pressure in the vessel entry line.

In separator 37 gas will rise to the top of the vessel and is removed through line 30 which is controlled by back pressure control valve 40. Gas may also be removed through control valve 41 which is remotely controlled. Manual valves 42 through 45 permit isolation of valves 40 and 41 for repairs. Flow rate meter 46 gives the operator information on gas production. Valve 47 provides a safety release to prevent the vessel reaching bursting pressure.

Oil which floats on the drilling fluid may be removed through line 48 which is controlled by valve 49 and its liquid level control 50. Oil may also be removed through valve 51 which is remotely controlled. Isolation valves 52 through 55 are provided for valves 48 and 51. Flow meter 56 gives information of oil production.

The remaining fluids in the separator (primarily drilling fluids) are removed through line 57 and valve 58 which is controlled by liquid level control 59. These fluids may also be removed through remote control valve 61. Flow meter 62 gives the operator the flow rate and isolation valves 63 through 66 permit isolation of valves 58 and 61. Liquid level monitors **67*a* through 67*d*** advise the operator of levels in the vessel.

Figure 4:
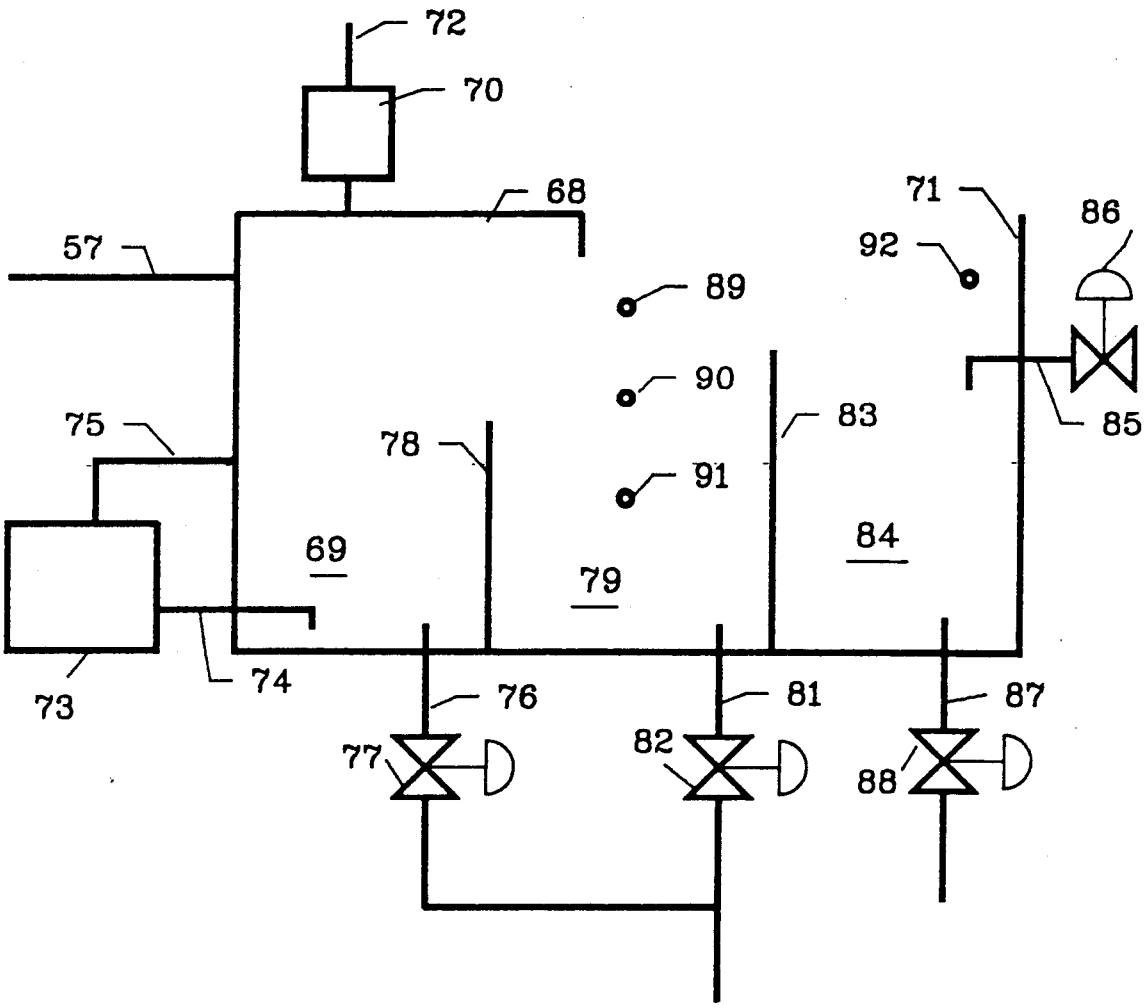
FIG. 4 is a schematic diagram of a preferred embodiment of an atmospheric separation vessel for receiving fluids from the pressure separator.

The final treatment and separation vessel 68 is shown in FIG. 4. Fluids from line 57 flows into compartment 69 and are reduced to atmospheric pressure. A high rate blower 70 draws air into the vessel through opening 71 and exhausts the air through opening 72 into the atmosphere. Any gas released from the liquids flowing into the vessel are mixed with air and discharged through opening 72. The volume of air passing through the tank is sufficient to render any gas released into the tank inflammable and non explosive.

A centrifuge 73 is connected to compartment 69. Fluids and particulate matter are withdrawn through line 74 and liquid is returned through line 75. The particulate matter from the centrifuge is conducted to a handling area not show. To assist in removing particulate matter in compartment 69 an inlet-outlet line 76 controlled by valve 77 permits introduction of drilling fluid into the bottom of the compartment to sweep the particles from the bottom of the compartment and suspend them in the liquid for treatment in the centrifuge.

Liquids from compartment 69 flow over baffle 78 into the drilling fluid accumulation compartment 79 and are withdrawn through line 81 controlled by valve 82. Oil floating on the top of drilling fluid in compartment 79 spills over baffle 83 into compartment 84. Oil is removed from the vessel through line 85 controlled by valve 86 and sent to storage.

Any drilling fluid accumulating in the bottom of compartment 84 is withdrawn through line 87 controlled by valve 88 and returned to the drilling fluid storage tank 17.

Liquid level indicators 89, 90, 91 and 92 transmit information to the central control unit and this information is utilized to remotely operate valves 77, 82, 86, and 88 to withdraw oil and drilling fluid from the vessel.

The above description assumes the availability of oil treatment facilities in the oil field to remove any entrained gas in the oil leaving the pressure vessel 37. If such facilities are not available oil would not be withdrawn through oil line 48. All liquid leaving the pressure vessel 37 would be directed to the atmospheric vessel 68 so that any gas entrained in both the drilling fluid and oil would be removed.

It will be seen from the above that a method has been provided for drilling with a drilling fluid consisting of liquids only which may not be of sufficient weight to contain the pressure in formations opened by drilling. The fluids forced to the surface under pressure are contained and treated to separate and recover the drilling fluids, oil and gas.

What is claimed is:

1. A drilling method comprising:

rotating a drill bit in a well head to drill a well in an earth formation while circulating drilling fluid consisting essentially of a liquid;

conducting the returning drilling fluid, and oil and gas from the formation to a flow rate control valve and to a pressure control valve;

conducting fluid from said flow rate control valve and said pressure control valve to a separator vessel maintained under pressure;

separating gas from the returning fluid in said separator vessel and conducting the separated gas from said separator vessel to disposal facilities;

conducting the remaining fluid in said separator vessel to an atmospheric separator vessel;

continuously circulating air through said atmospheric separator vessel to dilute to an inflammable mixture and to remove any well gases therein, and separating the oil and drilling fluid in said atmospheric separator vessel and conducting the oil to disposal and returning the drilling fluid to the well.

2. The method of claim 1 wherein said pressure control valve is a differential valve.

3. The method of claim 1 wherein oil is separated from the fluid in said separator vessel under pressure and conducted to disposal facilities prior to conducting the remaining fluid to the atmospheric separator vessel.

* * * * *